US005993222A

United States Patent [19]

Nicolette et al.

[11] Patent Number: 5,993,222

[45] Date of Patent: Nov. 30, 1999

[54] MOVING ELECTRICAL CONTACT FOR TRACK MOUNTED SYSTEMS

[75] Inventors: Thomas A. Nicolette, Centerport; Peter Y. Zhou; Dexing Pang, both of Smithtown, all of N.Y.

[73] Assignee: Sentry Technology, Corp., Hauppauge, N.Y.

[21] Appl. No.: 08/966,641

[22] Filed: Nov. 10, 1997

[51] Int. Cl.[6] ..... H01R 41/00

[52] U.S. Cl. ..... 439/32; 439/200; 191/59.1

[58] Field of Search ..... 439/110, 862, 439/200, 121, 111, 112, 887, 66, 32; 200/264; 191/59.1

[56] References Cited

U.S. PATENT DOCUMENTS

| | | | |
|---|---|---|---|
| 428,742 | 5/1890 | Brush | 200/264 |
| 1,796,156 | 3/1931 | McMorris | 439/200 |
| 3,246,074 | 4/1966 | Neumann | 439/110 |
| 3,585,573 | 6/1971 | Robshaw | 439/887 |
| 5,241,380 | 8/1993 | Benson | 358/108 |
| 5,704,794 | 1/1998 | Lindeman | 439/66 |

*Primary Examiner*—Neil Abrams
*Assistant Examiner*—Javaid Nasri
*Attorney, Agent, or Firm*—Stroock & Stroock & Lavan LLP

[57] ABSTRACT

A moving electrical contact for connecting a track-mounted moveable carriage to a signal rail. The moving electrical contact comprises a spring plate secured to the moveable carriage on one end and a contact pad attached to the other end of the spring plate. The contact pad is biased against the signal rail by the tension in the spring plate. The contact pad is constructed from approximately sixteen layers of a wire mesh consisting of tin coated, stainless steel conductive wire knitted in a tricot pattern and may include conducting jelly.

13 Claims, 5 Drawing Sheets

MOVING ELECTRICAL CONTACT FOR TRACK MOUNTED SYSTEMS

BACKGROUND OF THE INVENTION

The present invention relates to an improved electrical contact for systems having a track-mounted, movable carriage in which power, control and/or monitored information is transmitted to and/or received from the movable carriage.

Moving electrical contacts are often used in systems that include an electrically-powered carriage that moves along a track. The movable carriage may be controlled by electrical signals transmitted to the movable device from a remote location. Also, the movable device may transmit information in the form of electrical signals to the remote location.

A system that uses moving electrical contacts to transmit power, control and/or monitored information is disclosed in U.S. Pat. No. 5,241,380 issued to Benson. Benson discloses a track mounted camera system adapted for surveillance of a large area. The system includes a carriage that is driven by a drive assembly longitudinally along a track assembly that is positioned along a selected path. A pair of electrically conducting signal rails are mounted adjacent and parallel to the track to provide power to the electric motor. Video cameras are mounted to the carriage for monitoring selected portions adjacent to the path. Output signals from the cameras are transmitted on the signal rails to a remote monitoring location. Control signals for controlling placement of the carriage along the track are also transmitted on the signal rails to the carriage.

The signal rail is a pair of spaced apart, electrically isolated conductors comprising cylindrical, copper tubing mounted and supported within semi-cylindrical grooves of an isolation block made of electrically insulating material. Each conductor is in slidable contact with at least one corresponding isolated slidable electrically conductive brush along the length of the rail. Each brush is biased against the respective conductor by a spring that is inserted within a support also made of electrically insulating mnaterial. The brushes are mounted to a support platform that is connected to the carriage thereby providing a moving electrical contact between the carriage and the signal rails.

Another prior art moving electrical contact is disclosed in the track-mounted surveillance system described in FIGS. 1, 1*a*. A carriage 15 carrying cameras 17 moves by wheels 10 attached thereto. The moveable electric contact consists of a pair of electrically conductive graphite wheels 10 which are mounted on a moveable carriage 15 and form an electrical connection with the carriage. The graphite wheel pair is in electrical contact with a pair of signal rails that extend longitudinally along the track (not shown). As the carriage moves along the track, the graphite wheel pairs provide an electrical connection between the carriage and the signal rails.

While the prior art moveable electric contacts worked for their intended purposes, a significant drawback of these prior art contacts is that they generate acoustic noise levels that are unacceptable for particular applications. For instance in track-mounted surveillance systems, high acoustic noise levels generated by the moving electrical contacts may enable people in the monitored area to determine the location of the carriage along the track. Another problem with the prior art contacts is that they are prone to wear and tear from continued used which causes the electrical connection to become unreliable.

By constructing moving electrical contacts in accordance with the present invention, undesirable acoustical noise is significantly reduced, a stable and reliable electrical connection is maintained and the life expectancy of the contact is significantly increased.

SUMMARY OF THE INVENTION

The present invention provides an improved moving electrical contact for track mounted systems that generates significantly less acoustic noise than prior art moving electrical contacts. In accordance with the present invention, the moving electrical contact consists of an electrically conductive spring plate which is secured at one end to the carriage forming an electrical connection with the carriage. An electrically conductive contact is connected to the other end of the spring plate and is biased against the signal rail by the tension of the spring plate. Thus, an electrically conductive path is formed between the signal rail and the carriage which may be used to transmit signals to and/or receive signals from the carriage.

Accordingly, it is an objective of the present invention to provide a moving electrical contact which generates significantly less acoustical noise than prior art movable contacts.

Another objective of the invention is to provide a movable electric contact that forms a reliable, and stable contact with a signal rail, while the contact is moving along the track and/or the carriage is vibrating.

A further objective of the invention is to provide a movable electric contact with a significantly increased life expectancy over prior art moveable contacts.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figures 1, 1A:
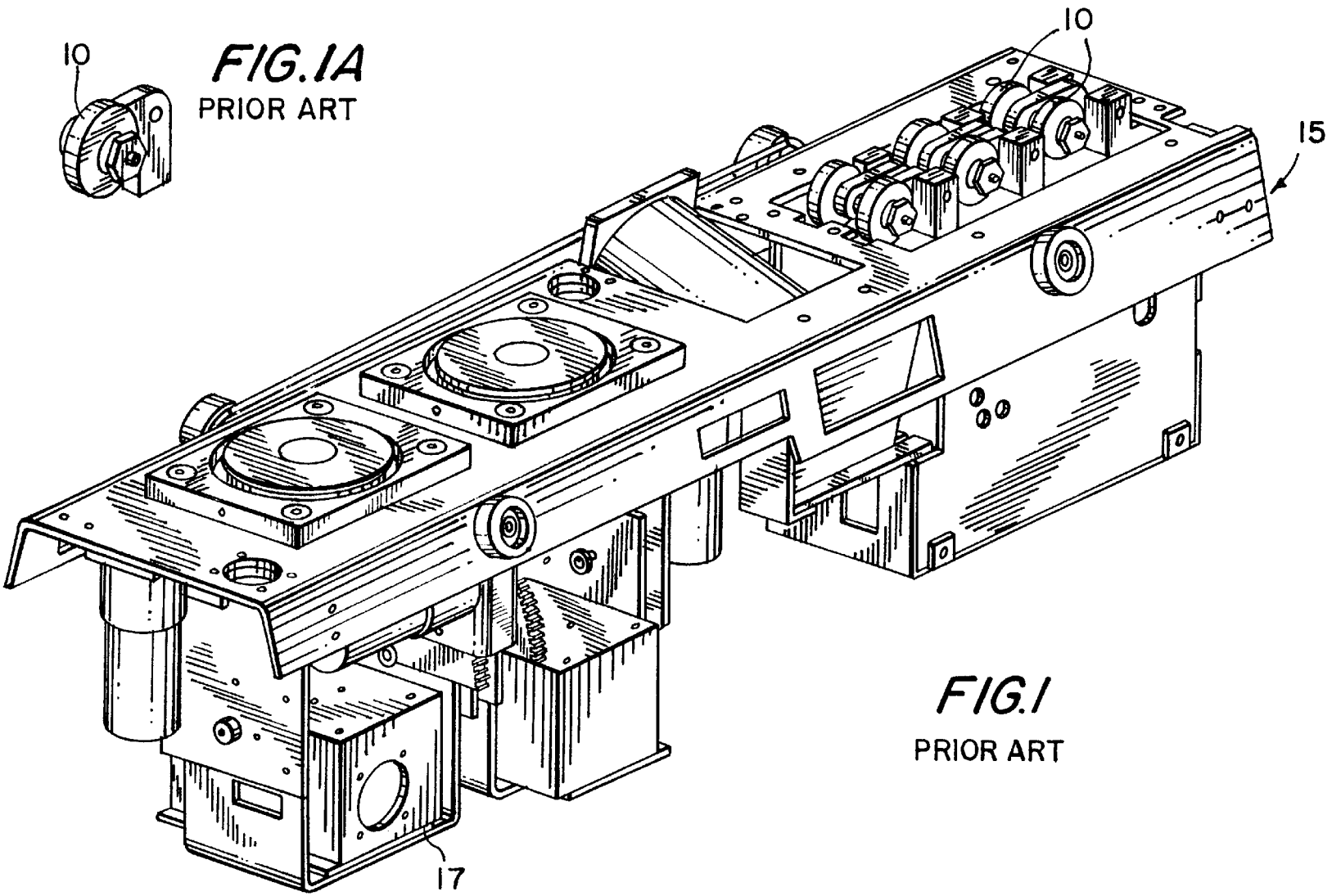
FIG. 1 PRIOR ART
FIG. 1A PRIOR ART
FIG. 1 is a perspectve view of a prior art moving electrical contact used in a track-mounted surveillance system.
FIG. 1*a* is an enlarged perspective view of the contact wheel.
Figure 2:
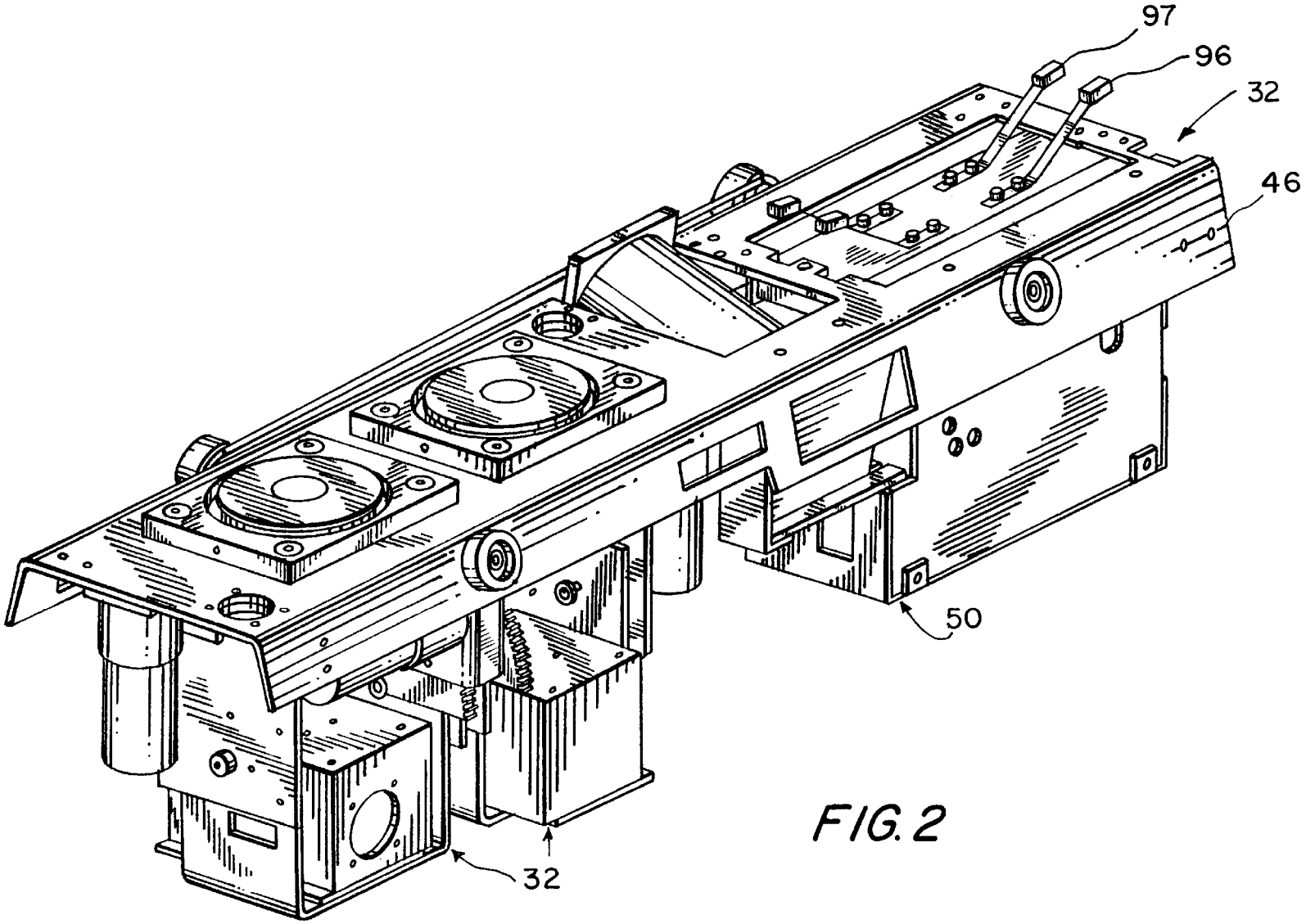
FIG. 2 is a perspective view of a track-mounted moveable carriage that uses the moveable electric contacts in accordance with the present invention.

Referring now to FIG. 2, there is shown a moveable carriage 32 that is used in track-mounted surveillance systems. Moveable carriage 32 comprises a frame 46. A drive assembly 48 for driving carriage 32 is mounted to the frame. A drive control and video circuit board generally shown as 50 for controlling operation of drive assembly 48 and a cameras 34 used to observe the monitored area are mounted to frame 46. Secured to frame 46 of the moveable carriage 32 are moving electrical contact pairs 96 and 97.

Figure 3:
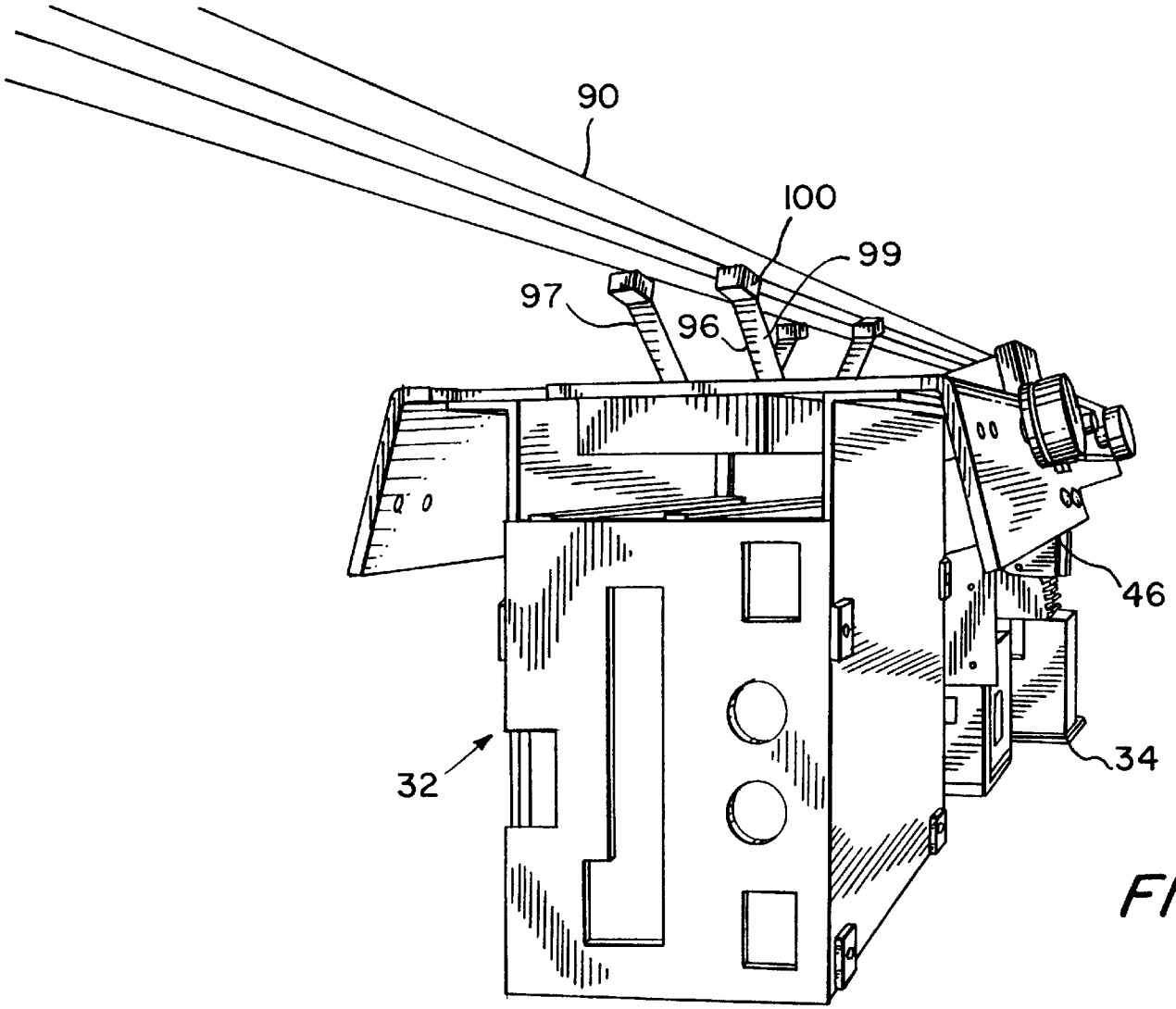
FIG. 3 is a perspective view of the connection between the moving electrical contacts and the signal rails.

Referring to FIG. 3, power and control signals are provided to moveable carriage 32 and monitored surveillance information is received from moveable carriage 32 along a pair of spaced apart, electrically isolated signal rails 90 that extend longitudinally along the track (not shown). The upper end of moving electrical contact pairs 96 and 97 are in contact with signal rails 90 thereby forming an electrically conductive path between moveable carriage 32 and signal rails 90. The lower portion of moving electrical contact pairs 96 and 97 is suitably secured to and forms an electrical connection with the moveable carriage 32. In a preferred embodiment, moving electrical contact pair 96 will transmit power from signal rails 90 to drive control and video circuit board 50 of moveable carriage 32, moving electrical contact pair 97 will transmit control signals from signal rails 90 to moveable carriage 32 and also transmit monitoring signals generated by cameras 34 from moveable carriage 32 to the signal rails 90.

Figure 4:
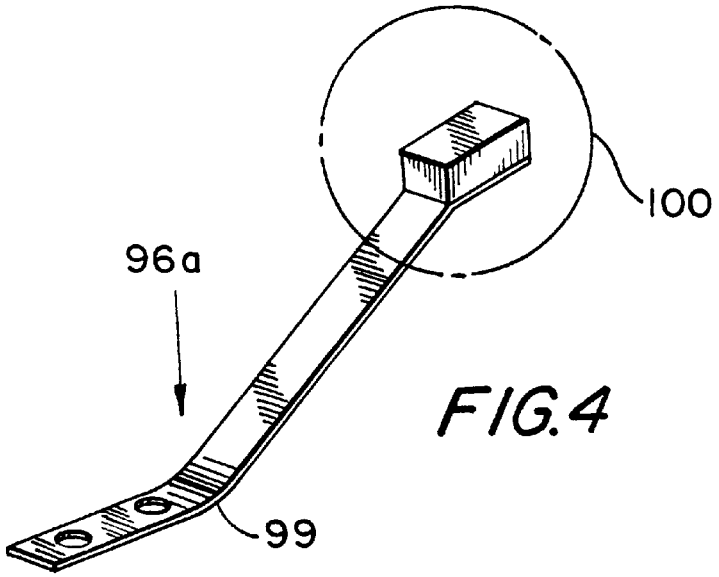
FIG. 4 is a perspective view of the moving electrical contact in accordance with the present invention.

Referring to FIG. 4, there is shown a single moving electrical contact 96 comprising a spring plate 99 formed from electrically conductive material, preferably made from bronze, but any type of conductive material may be used so long as it exhibits conductive properties. Fixed to the upper portion of the spring plate is an electrical contact pad 100. Contact pad 100 is biased against signal rails 90 in FIG. 3 by the bending force of spring plate 99 thereby providing a reliable and stable electrical contact with signal rails 90.

Figure 5:
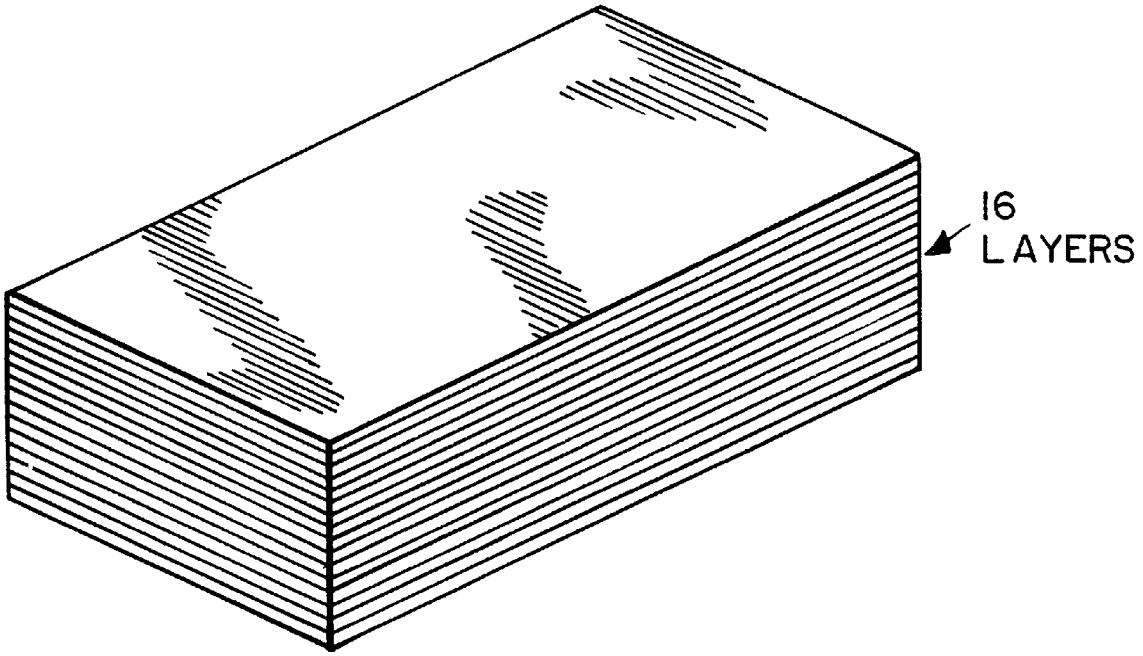
FIG. 5 is an enlarged perspective view of the contact pad contained in the moving electrical contact of FIG. 4.

Referring to FIG. 5, there is shown an enlarged view of contact pad 100 constructed from electrically conductive material. In a preferred embodiment, contact pad 100 is a compressible block having a height of 0.25", a width of 0.25" and depth of 0.60" and is formed from approximately sixteen layers of a wirn mesh 101 illustrated in FIG. 6. However, it will be obvious to one with ordinary skill in the art that contact pads of other shapes, sizes and constructions may also be used. By making pad 100 compressible pad 100 can adjust to fill gaps between signal pipes 90 and spring plates 96, 97 as a result of movement of carriage 32; maintaining good consistent electrical contact between pipes 90 and carriage 32.

Figure 6:
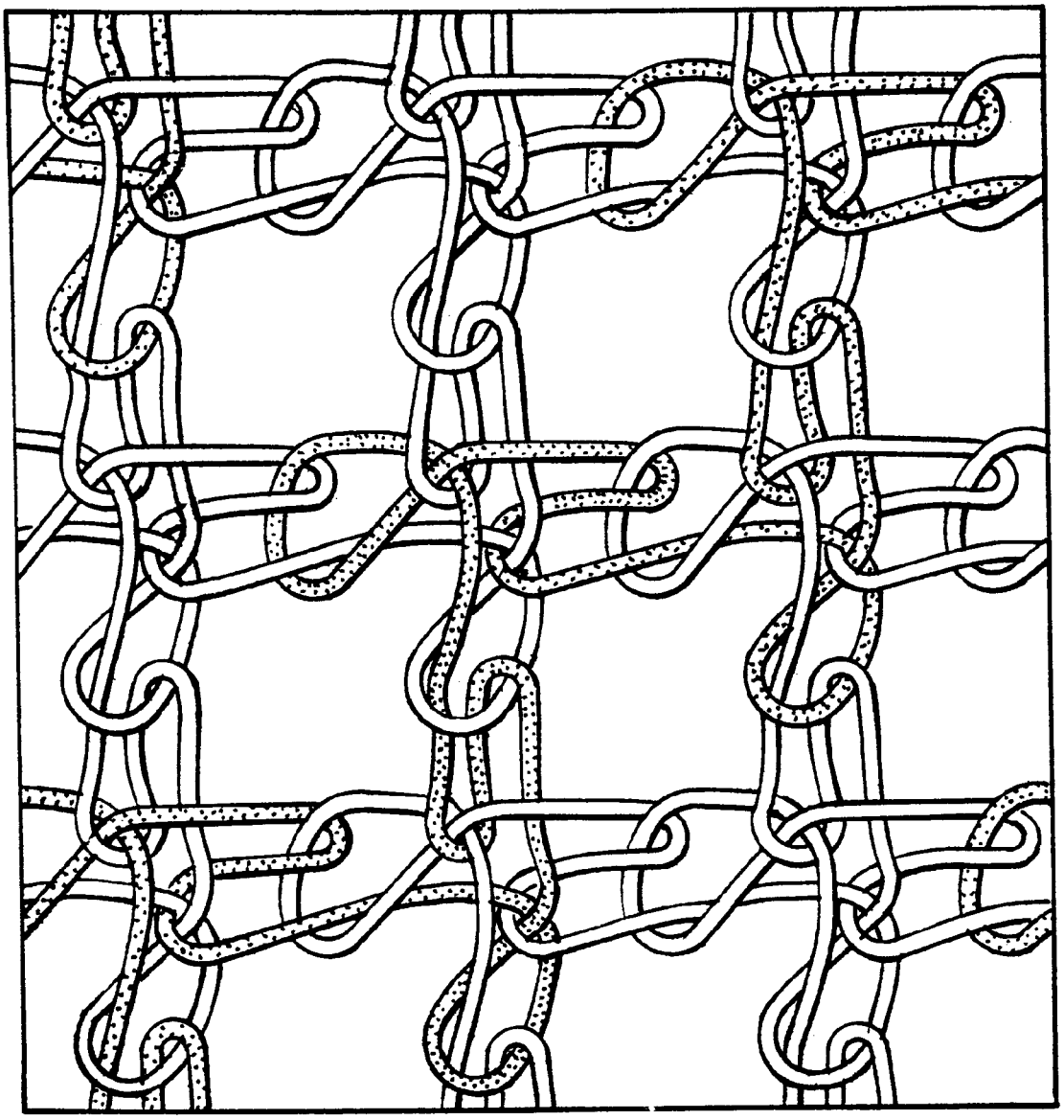
FIG. 6 is an enlarged perspective view of the wire mesh pattern used to form the contact pad of FIG. 5.

Referring to FIG. 6, there is shown wire mesh layer 101 used to form contact pad 100 in the preferred embodiment. Wire mesh 101 is constructed from conductive wire 102 preferably of tin-coated, stainless steel having a diameter of 0.005". Conductive wire 102 is preferably knitted into a pattern that will not loosen even when some of the wires are broken. An example of such a pattern is the tricot pattern illustrated in FIG. 6. Preferably, the density of wire mesh 101 will be 25×25 per square inch. Wire mesh 101 may then be rolled into a bundle and suitably shaped to form contact pad 101 of FIG. 5. The electrical and acoustical benefits provided by contact pads formed in such a manner may be further improved by applying conducting jelly to contact pad 100. It will be obvious, however, to one with ordinary skill in the art that a wire mesh constructed of other materials and knitted into oiher patterns may also be used.

It has been found that the wear and tear on moving electrical contacts formed in accordance with this invention is significantly less than that suffered by prior art moveable contacts. As a result, the moving electrical contact of the present invention maintains a stable and reliable electrical connection with the signal rail. In addition, the moving electrical contacts of the present invention generate significantly less acoustical noise than do prior art moveable contacts. As each layer of wire mesh 101 is worn, another layer sits behind it to continue in an uninterrupted manner, the conductive path. Moreover, the tension between spring plate 99 and signal rails 90 is also maintained. However, it should be noted that wheels may also be placed at the ends of spring arms 96, 97.

The moving electrical contacts of the present invention may be used in a variety of applications that require an electrical connection between an object moving along a track and a remote power source or monitoring device. Such applications include remote control robots, positioning of overhead tools and the like. One such application is the track mounted surveillance system disclosed in Benson (U.S. Pat. No. 5,241,380) where the acoustical noise generated by the moving electrical contacts would alert people in the monitored area as to the location of the cameras, thereby undermining the benefit of using a track-mounted surveillance system.

It will thus be seen that the objects set forth above, and those made apparent from the preceding description, are efficiently attained and, because certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described, and all statements of the scope of the invention which, as a matter of language, might be said to fall therebetween.

What is claimed is:

1. A moving electrical contact for connecting a track-mounted moveable carriage to a signal rail comprising: a spring plate having a first end and a second end, the first end for securing the spring plate to the moveable carriage; and a knitted pad contact coupled to the second end of the spring plate, said contact biasedly contacting the signal rail to enable the movable carriage to transmit/receive power and control signals to/from the signal rail while moving along the signal rail.

2. The apparatus of claim 1, wherein the spring plate is constructed from electrically conducting material thereby forming an electrical connection with the moveable carriage.

3. The apparatus of claim 1, wherein the spring plate biases the contact against the signal rail.

4. The apparatus of claim 1, wherein the contact is a compressible pad constructed from electrically conducting material thereby forming an electrical connection with the signal rail.

5. The apparatus of claim 4, wherein the contact pad consists of a plurality of wire mesh layers of conductive wire.

6. The apparatus of claim 5, wherein the conductive wire is stainless steel.

7. The apparatus of claim 6, wherein said conductive wire is copper cladded.

8. The apparatus of claim 5, wherein the wire mesh is knitted in a pattern such that the wire mesh does not loosen when a wire is broken.

9. The apparatus of claim 8, wherein the knitted pattern is a tricot pattern.

10. The apparatus of claim 4, further including conducting jelly, said conducting jelly being applied to the contact pad for lubricating the connection between the contact pad and the signal rail.

11. The apparatus of claim 1, wherein the moving electrical contact transmits power from the signal rail to the moveable carriage to drive the moveable carriage along the track.

12. The apparatus of claim 1, wherein the moving electrical contact transmits control signals from the signal rail to the moveable carriage to control the placement of the moveable carriage along the track.

13. The apparatus of claim 1, wherein the moving electrical contact transmits monitoring signals generated by a camera attached to the moveable carriage from the moveable carriage to the signal rail.

* * * * *